US009612095B2

(12) United States Patent
Smart et al.

(10) Patent No.: US 9,612,095 B2
(45) Date of Patent: Apr. 4, 2017

(54) COMPOSITE SHAPED CHARGES

(71) Applicant: Schlumberger Technology Corporation, Sugar Land, TX (US)

(72) Inventors: Moises Enrique Smart, Houston, TX (US); Claude Jones, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/968,473

(22) Filed: Dec. 14, 2015

(65) Prior Publication Data

US 2016/0169639 A1 Jun. 16, 2016

Related U.S. Application Data

(60) Provisional application No. 62/091,274, filed on Dec. 12, 2014, provisional application No. 62/091,288, filed on Dec. 12, 2014.

(51) Int. Cl.
*F42B 1/02* (2006.01)
*F42B 1/032* (2006.01)
*F42B 1/028* (2006.01)

(52) U.S. Cl.
CPC ..... *F42B 1/032* (2013.01); *F42B 1/028* (2013.01)

(58) Field of Classification Search
CPC .... F42B 1/00; F42B 1/02; F42B 1/032; F42B 1/036; F42B 12/10; F42B 12/20; F42B 12/207; F42B 12/208; F42B 12/72; F42B 3/08; F42B 3/22; F42B 12/18; F42B 12/14; F42D 1/10; F42D 1/12
USPC ..... 102/306, 308, 310, 315, 317
See application file for complete search history.

(56) References Cited

U.S. PATENT DOCUMENTS 2,426,997 A * 9/1947 Gray ..... F42B 12/10 102/476
2,604,042 A * 7/1952 Cook ..... B21D 26/08 101/109
2,628,559 A * 2/1953 Jasse ..... F42B 1/02 102/306
2,717,552 A * 9/1955 Brandt ..... F42B 10/06 102/222
2,843,041 A * 7/1958 Stewart ..... E21B 43/116 102/310
2,900,905 A * 8/1959 MacDougall ..... F42B 1/024 102/306
2,935,020 A * 5/1960 Howard ..... E21B 29/02 102/307
3,034,393 A * 5/1962 Lieberman ..... F42B 1/036 102/306

(Continued)

*Primary Examiner* — Derrick Morgan
(74) *Attorney, Agent, or Firm* — Tuesday Kaasch

(57) ABSTRACT

Embodiments may take the form of a composite shaped charge. In an example embodiment, a shaped charge includes a casing, an energetic material positioned within the casing, and a liner substantially covering the energetic material. At least one of the casing, the energetic material, and the liner comprises a composite construction. An example embodiment may take the form of a case having a composite construction. An example embodiment may take the form of an energetic material having a composite construction. An example embodiment may take the form of a liner having a composite construction.

16 Claims, 4 Drawing Sheets

(56) References Cited

U.S. PATENT DOCUMENTS 3,054,938 A * 9/1962 Meddick ..... E21B 43/117 102/310
3,090,306 A * 5/1963 Reuther ..... F41H 11/12 102/305
3,188,955 A * 6/1965 Brown ..... F42B 1/02 102/306
3,276,369 A * 10/1966 Bell ..... E21B 43/117 102/306
3,561,361 A * 2/1971 Kessenich ..... F42B 1/024 102/307
3,688,702 A * 9/1972 Prior ..... F42C 19/09 102/204
4,170,940 A * 10/1979 Precoul ..... F42B 1/02 102/476
4,305,324 A * 12/1981 Precoul ..... F42B 1/02 86/20.12
4,436,033 A * 3/1984 Precoul ..... F42B 1/028 102/307
4,606,272 A * 8/1986 Kerdraon ..... F42C 19/06 102/202.12
4,627,353 A * 12/1986 Chawla ..... F42B 1/02 102/307
4,632,036 A * 12/1986 Ringel ..... F42C 19/09 102/310
4,665,826 A * 5/1987 Marer ..... F42B 1/024 102/401
4,669,384 A * 6/1987 Chawla ..... F42B 1/02 102/307
4,896,609 A * 1/1990 Betts ..... F42B 1/02 102/307
4,955,939 A * 9/1990 Petrousky ..... F42B 12/10 102/306
5,020,439 A * 6/1991 Winter ..... F42B 12/204 102/473
5,322,020 A * 6/1994 Bernard ..... F42B 1/024 102/306
6,352,029 B1 * 3/2002 Guirguis ..... C06B 45/12 102/286
6,840,178 B2 * 1/2005 Collins ..... F42B 1/032 102/307
7,621,221 B2 * 11/2009 Ritman ..... F42B 1/028 102/306
8,444,785 B2 * 5/2013 Hugus ..... C06B 45/00 102/306
2001/0052303 A1 * 12/2001 Mayseless ..... F42B 1/028 102/306
2002/0189482 A1 * 12/2002 Kneisl ..... C06B 45/10 102/306
2003/0116049 A1 * 6/2003 Han ..... F42B 1/02 102/306
2004/0200377 A1 * 10/2004 Collins ..... F42B 1/032 102/476
2005/0115391 A1 * 6/2005 Baker ..... F42B 1/02 89/1.151
2005/0115448 A1 * 6/2005 Pratt ..... F42B 1/032 102/476
2006/0102040 A1 * 5/2006 Johansson ..... F42B 12/10 102/476
2010/0139515 A1 * 6/2010 King ..... F42B 1/036 102/309
2011/0219978 A1 * 9/2011 Glenn ..... F42B 1/028 102/307

* cited by examiner

COMPOSITE SHAPED CHARGES

CROSS-REFERENCE TO RELATED APPLICATIONS

The application claims priority of the U.S. Provisional Application No. 62/091,274, filed Dec. 12, 2014, and of U.S. Provisional Application No. 62/091,288, filed Dec. 12, 2014. The disclosures of these provisional applications are incorporated by reference in their entirety.

BACKGROUND

After a well has been drilled and a casing has been cemented in the well, perforations are created to allow communication of fluids between pay zones in the formation and the wellbore. Perforating guns having shaped charges are conveyed into the well on an electric line (e.g., a wireline) or tubing (e.g. production tubing, drill pipe, or coiled tubing). The wireline or tubing conveyance may be directed to a given zone and the perforating gun fired to create perforation tunnels through the well casing. The jet formed by the detonation of the shaped charge may pierce steel casing, cement and a variety of different types of rock that make up the surrounding formation. The shaped charges form perforations or tunnels into the surrounding formation upon detonation. The profile, depth and other characteristics of the perforations are dependent upon a variety of factors.

SUMMARY

Embodiments may take the form of a composite shaped charge. In an example embodiment, a shaped charge includes a casing, an energetic material positioned within the casing, and a liner substantially covering the energetic material. At least one of the casing, the energetic material, and the liner comprises a composite construction. An example embodiment may take the form of a case having a composite construction. An example embodiment may take the form of an energetic material having a composite construction. An example embodiment may take the form of a liner having a composite construction.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

DETAILED DESCRIPTION

In the following description, numerous details are set forth to provide an understanding of the present disclosure.

However, it will be understood by those skilled in the art that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

In the oil and gas industry shaped charges are used to establish connection between the reservoir and the wellbore. In general, a shaped charge includes a metallic case, a liner material and an explosive/energetic material sandwiched in between. The characteristics of different components of the shaped charge itself may determine the characteristics of the jet and ultimately the depth, profile and overall effectiveness of each given perforation. As the demand for oil/gas continues, the demand for better shaped charges continues. Present embodiments may take the form of a shaped charge explosive made out of composite energetic materials.

Figure 1:
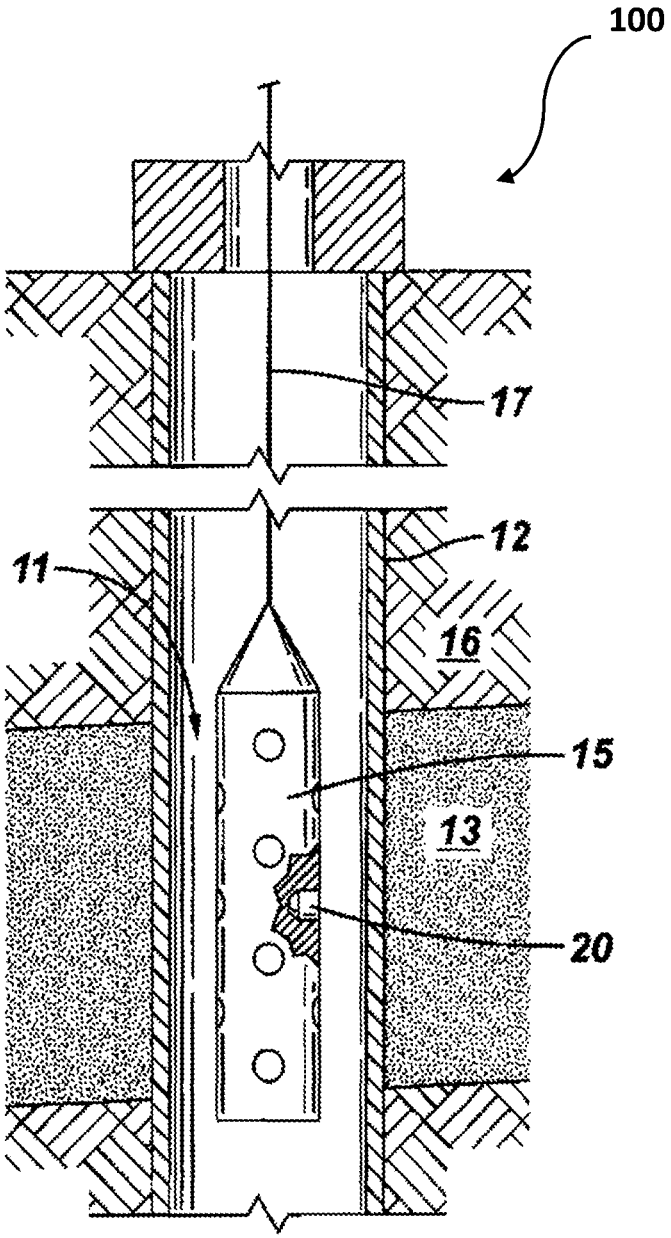
FIG. 1 illustrates perforating gun positioned within a cased well bore.

FIG. 1 illustrates a well 11 with a casing 12 lining the sidewalls of the well. The casing commonly made of cement helps maintains well integrity but also seals off the wellbore from the formation. A perforating gun 15 having multiple shaped charges 20 may be deployed into the well 11 until it is adjacent to the formation 16 which may include a "target zone" 13. To perforate the casing 12, the perforating device 15 is fired and the shaped charges 20 detonate sending a high velocity jet outward from the gun creating holes in the casing 12 and perforations into the target zone 13 of the formation. Production fluids in the target zone 13 can then flow through the perforation in the casing, and into the wellbore.

As may be appreciated, characteristics of the jet formed upon detonation of the shaped charge are largely dependent upon the behavior of the shaped charge components. Generally, shaped charges include a case (or housing), explosive material, and a liner. In accordance with present examples, one or more of the case, explosive material, and liner may be created as a composite. That is, for example, the case, the explosive material, or the liner (or any combination of the case, the explosive material and the liner) may include several different constituent component materials. Each of the different constituent part may form a different portions of the case, energetic material, or liner, respectively.

Figure 2:
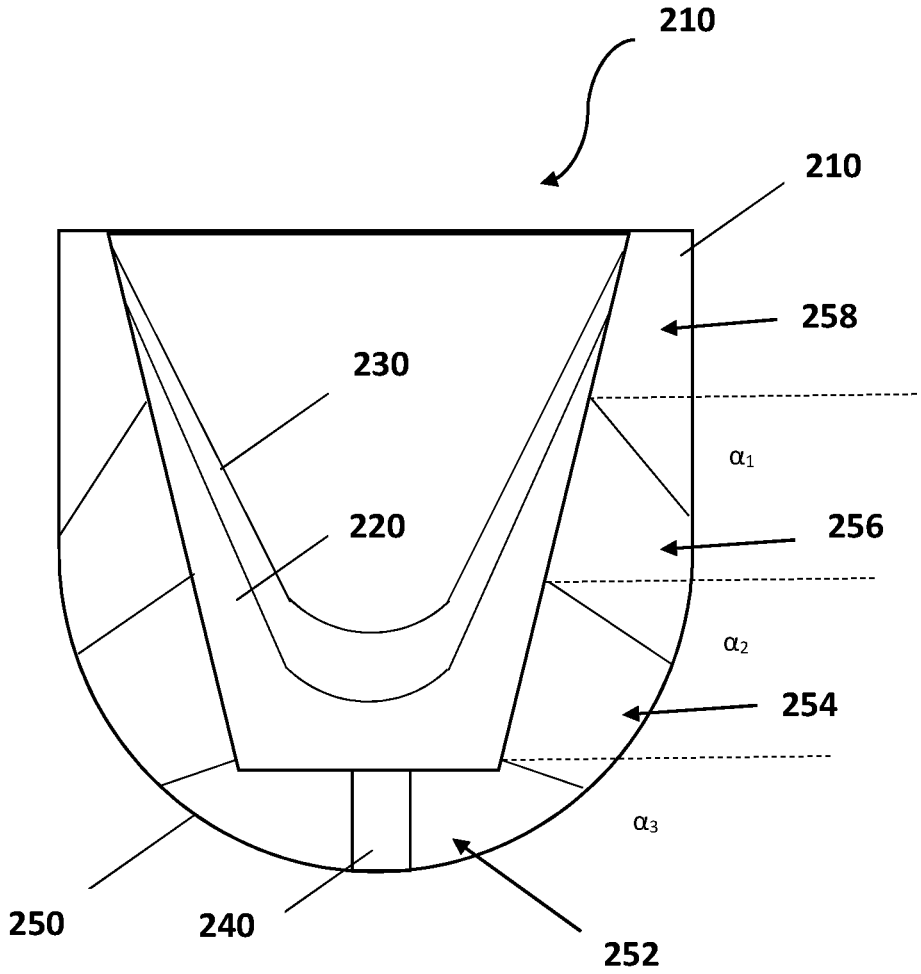
FIG. 2 illustrates a shaped charge usable with the perforating gun of FIG. 1 in accordance with an example embodiment.

FIG. 2 illustrates an example shaped charge 200 having a composite case 210. The shaped charge 200 includes the casing 210, an explosive material 220, and a liner 230. The casing 210 may take any suitable shape and generally includes a concave or hollow volume into which the explosive material 220 and the liner 230 are positioned. The liner 230 generally covers the explosive material 220 so that the explosive material is positioned between the case 210 and the liner. At or near a base 250 of the case 210 a primer 240 may be positioned in a hole in the case.

As illustrated, the case 210 is a composite construction with the base 250 having a first material 252, and different materials 254, 256, and 258 forming the sidewalls of the case. It should be appreciated that in some embodiments, the base 250 may be formed of multiple different materials. In some embodiments, the differences between adjacent materials may include different base material (e.g., aluminum, titanium, steel, etc.). In some embodiments, the differences in the materials 252, 254, 256, and 258 may include different alloying agents in a base material. In some embodiments, adjacent materials may be different, while non-adjacent materials may be the same (e.g., 252 and 254 may be different materials, but 252 and 256 may be the same material). In some embodiments, the differences between adjacent materials may be in geometry. In still further embodiments, the adjacent materials may differ in both geometry and material.

In some embodiments, the case 210 may be constructed using either unidirectional or a multidirectional series of rings consisting of a combination of, for example, carbon steel, metals (e.g., aluminum, titanium, etc.), metal alloys, or any other suitable material combination may be implemented. The rings may be joined together using any suitable technique. For example, in some embodiments, the rings may be joined together using adhesive or an epoxy. In some embodiments, the rings may be coupled together using threading. In other embodiments, the rings may be coupled together using pressure. It should be appreciated that more than one technique may be implemented to join the rings together.

In some embodiments, the materials 252, 254, 256 and 258 may be joined at variable angles $\alpha$. In the illustrated embodiment, the angles $\alpha$ increase moving up the sidewall. As such, the angle $\alpha$1 (interface between materials 256 and 258) is greater that the angle $\alpha$3 (interface between materials 252 and 254). It should be appreciated that the angles may vary in accordance with any suitable scheme in order to achieve a desired characteristic of the case's performance. In some embodiments, the angles may be the same (e.g., do not vary) at one or more material interfaces.

The composite material for the case 210 may be selected to obtain certain desired characteristics to enhance the shaped charge performance in particular applications. For example, the composite materials may be selected for: debris control; deeper penetration/enhance productivity (e.g., using a combination of high density materials such as tungsten, copper, tantalum-tungsten, tungsten-nickel-iron, tungsten carbide-cobalt, steel, amorphous solids, Mo-tungsten, and so forth in powder metal or solid form); combined deep penetrator with big hole shaped charge (e.g., using materials with various density (for example on of the high density materials listed above with a material having a lower density) and an angle of interface that helps improve the depth of penetration (such as angles ranging from 20 degrees to 180 degrees including those in the range of 30 degrees to 90 degrees); and/or perforating and cleanup (e.g., combining high density energetic material with propellants, reactive materials, and/or other energetic materials).

Figure 3:
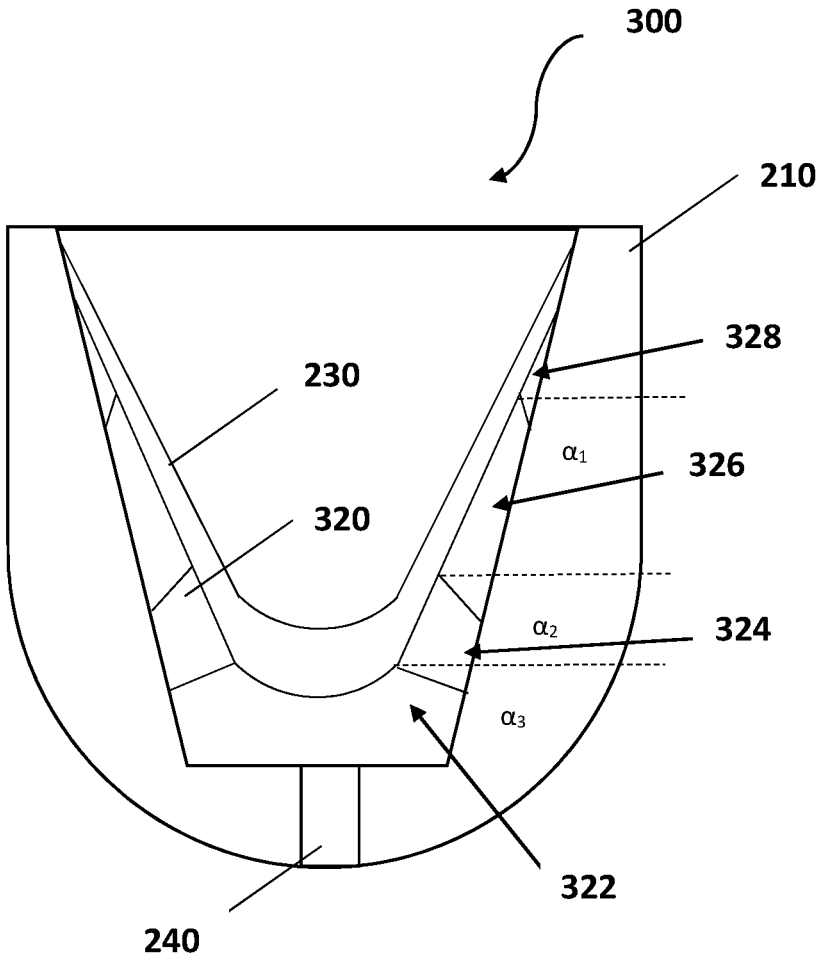
FIG. 3 illustrates another shaped charge usable with the perforating gun of FIG. 1 in accordance with an example embodiment.

FIG. 3 illustrates an example shaped charge 300 with a composite explosive material 320. The shaped charge includes a case 310, the composite explosive material 320 and the liner 330. The composite explosive material includes different explosive materials arranges to form the explosive section of the shaped charge 300. Any suitable explosive material may be implemented. In some embodiments, either unidirectional or multidirectional series of lamina including, one or more of the following example explosive materials: HMX, RDX, SX-2, NONA, PYX, propellants, reactive materials may be implemented.

In FIG. 3, the composite explosive material 320 includes four sections of explosive material (explosive material 322, 324, 326 and 328) although it should be appreciated that any number of explosive materials may be used (including fewer or more than four) in order to achieve a desired result. Each section of explosive material 322, 324, 326, and 328 may have different material and/or geometrical properties. Additionally, an interface between two materials may be formed at a variable angle $\alpha$. For example, an interface between materials 322 and 324 may have a smaller angle than that of the interface between materials 326 and 328. The interfaces may include an adhesive, epoxy or other suitable joining mechanism to help the different materials to help with continuity between materials and to form a unitary member. In some embodiments, the materials are joined together by pressure as the materials are pressed into the case 310.

The explosive materials and their arrangement are selected to provide one or more certain desired characteristics. For example, the explosive materials may be selected for certain applications to provide: deeper penetration/enhance productivity (e.g., using a combination of high density energetic materials such as HMX and RDX to help form of a continuous, coherently stretching jet); combined deep penetrator with big hole shaped charge (e.g., using materials with various density (such as tungsten, copper, tantalum-tungsten, tungsten-nickel-iron, tungsten carbide-cobalt, steel, amorphous solids, Mo-tungsten, and so forth in powder metal or solid form) and a join angle between 20 degrees and 180 degrees (such as between 30 degrees and 90 degrees) selected to provide the deeper penetration and larger hole); and/or perforating and cleanup (e.g., combining high density energetic material with propellants, reactive and/or other energetic materials).

Figure 4:
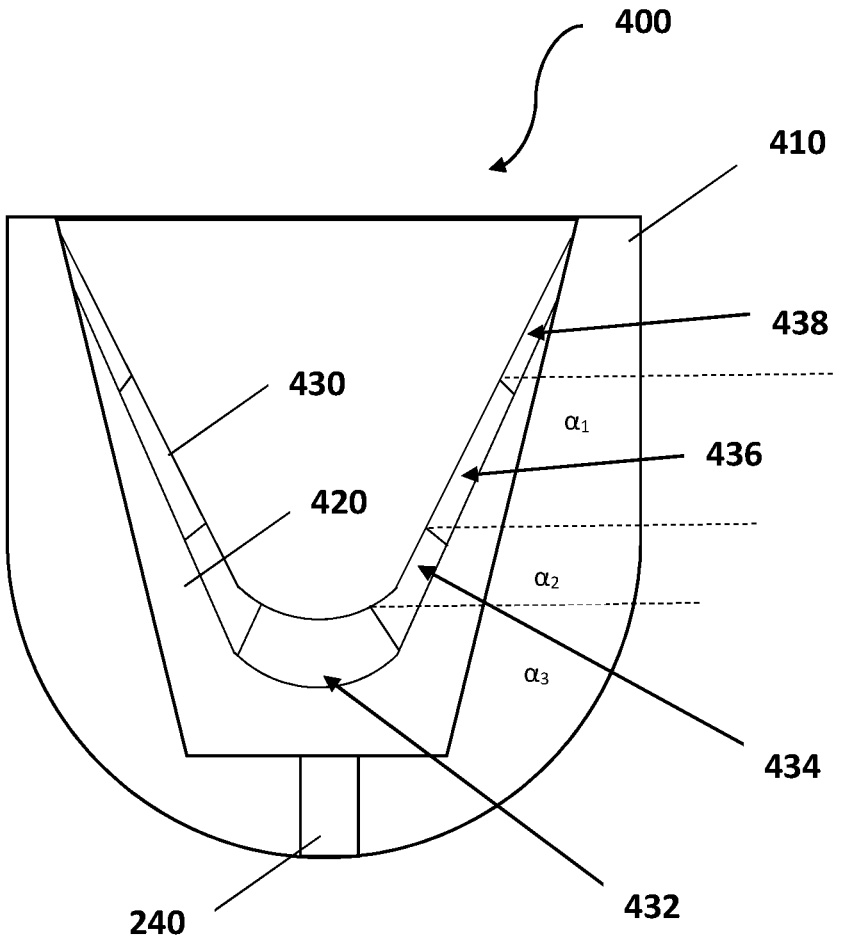
FIG. 4 illustrates yet another shaped charge usable with the perforating gun of FIG. 1 in accordance with an example embodiment.

FIG. 4 illustrates an example shaped charge 400 with a composite liner 430. In some embodiments, either unidirectional or multidirectional series of lamina consisting of, for example, amorphous material glass, materials made out of metallic elements/oxides, reactive materials (e.g., thermite), metals (e.g., tungsten and titanium) and metal alloys may be implemented. The liner 430 may take the form of a liner made out of a number of different materials 432, 434, 436, and 438 each having different material and/or geometrical properties. The materials 432, 434, 436, and 438 may be joined at a variable angles using epoxy and/or pressure, to both hold together the composite structure and helping with continuity between materials. The material selection may be directed to obtain desired characteristics to improve the performance of the shaped charge 430 in particular applications, such as: deeper penetration/enhance productivity (e.g., using a combination of high density material such as tungsten and an amorphous materials helps the formation of a continuous, coherently stretching jet); big hole charges for hydraulic fracturing and sand control (e.g., a combination of solid metal liner with high density powder metal may help formation of a big hole in the casing combined with deep perforation); combined deep penetrator with big hole shaped charge (e.g., using materials with various density (such as tungsten, copper, tantalum-tungsten, tungsten-nickel-iron, tungsten carbide-cobalt, steel, amorphous solids, Mo-tungsten, and so forth in powder metal or solid form and materials having lower or higher densities) and variable join angles between approximately 20 degrees and 180 degrees including those between 30 degrees and 90 degrees may be implemented); perforating and cleanup (e.g., combining high density metal powder and/or solid metal with propellants, reactive and/or other energetic materials); perforation plug (e.g., combining amorphous materials with solid metal liner).

In some embodiments, more than one of the case, the explosive material, and the liner may have a composite construction. For example, in an example embodiment, the case and the liner may both have a composite construction. In such an embodiment, the interface or join angles may vary within each of the liner and the case. The angles between the case materials in the case and the liners may vary, as well. In some embodiments, one or more angle may be the same. Additionally, one or more material, geometry, or angle may be common between the explosive material, the liner, and the case.

Any suitable manufacturing process may be used to manufacture the shaped charges described herein. In some embodiments, additive manufacturing may be implemented. For example, at least one of the case, explosive material or liner maybe formed using an additive manufacturing process. As such, one or more parts of the shaped charge may be printed. An additive, such as a binder, adhesive, or epoxy may be implemented to help hold the constituent parts of the composite construction together and to provide continuity between the composite parts.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

What is claimed is:

1. A shaped charge comprising:

a casing;

a plurality of energetic materials positioned within the casing;

a liner substantially covering the energetic materials, wherein a first of the energetic materials is a first substantially annular ring, wherein a second of the energetic materials is a second substantially annular ring, and wherein the first and second substantially annular rings each extends radially-between the casing and the liner;

wherein the first energetic material is positioned farther away from a central apex of the liner than the second energetic material;

wherein a first angle is defined between the first energetic material and the second energetic material with respect to a central longitudinal axis through the casing, wherein a second angle is defined between the second energetic material and a third of the energetic materials with respect to the central longitudinal axis through the casing, and wherein the first angle is different than the second angle; and wherein the first angle is more acute than the second angle.

2. The shaped charge of claim 1, wherein the first energetic material and the second energetic material are two different materials.

3. The shaped charge of claim 2, wherein a base of the casing and at least a portion of a sidewall of the casing comprise different materials.

4. The shaped charge of claim 3, wherein the sidewall of the casing comprises a first section adjacent to the base of the casing having a first material and a second section adjacent to the first section comprising a second material different from that of the first section.

5. The shaped charge of claim 4, wherein the casing comprises one or more of: tungsten, copper, tantalum-tungsten, tungsten-nickel-iron, tungsten carbide-cobalt, steel, amorphous solids, and Mo-tungsten, in powder metal or solid form.

6. The shaped charge of claim 4, wherein the first section and second section are joined at an angle $\alpha_x$.

7. The shaped charge of claim 5, further comprising a third section adjacent the second section, the third section comprising a third material and joined with the second section at angle $\alpha_y$ different from that of an angle $\alpha_x$.

8. The shaped charge of claim 4, wherein the first section and second section are coupled together using at least one of epoxy, threads, or pressure to provide continuity between materials.

9. The shaped charge of claim 1, further comprising a third energetic material positioned within the casing, wherein the second energetic material is positioned between the first and third energetic materials, and wherein the first energetic material comprises a different material than the second energetic material.

10. The shaped charge of claim 9, wherein the first energetic material is coupled to the second energetic material using at least one of epoxy, threads, or pressure to provide continuity.

11. The shaped charge of claim 1, wherein the liner comprises a composite construction including at least two different materials.

12. The shaped charge of claim 11, wherein the liner comprises a composite construction including at least two different materials.

13. The shaped charge of claim 11, wherein the liner comprises a solid metal and a powdered metal.

14. The shaped charge of claim 11, wherein the liner comprises at least one of: tungsten, copper, tantalum-tungsten, tungsten-nickel-iron, tungsten carbide-cobalt, steel, amorphous solids, and Mo-tungsten in powder metal or solid form.

15. A method of manufacturing a shaped charge comprising:

forming a case;

placing a plurality of energetic materials within a volume defined by the case, wherein a first of the energetic materials is a first substantially annular ring, wherein a second of the energetic materials is a second substantially annular ring;

positioning a liner over the energetic materials, wherein the first and second substantially annular rings each extends radially-between the case and the liner;

positioning the first energetic material farther away from a central apex of the liner than the second energetic material;

defining a first angle between the first energetic material and the second energetic material with respect to a central longitudinal axis through the casing, defining a second angle between the second energetic material and a third of the energetic materials with respect to the central longitudinal axis through the casing, wherein the first angle is different than the second angle; and wherein the first angle is more acute than the second angle.

16. The method of claim 15, wherein the first energetic material and the second energetic material comprise different high density materials that are coupled together using at least one of: adhesive, epoxy, threading, and pressure to provide continuity between the different materials.

* * * * *